US008388267B2

(12) United States Patent
Breaux et al.

(10) Patent No.: US 8,388,267 B2
(45) Date of Patent: Mar. 5, 2013

(54) BALLASTED DRIVEN PILE

(75) Inventors: Larry Dwayne Breaux, Houston, TX (US); Mark DeWitt Slider, Houston, TX (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

(21) Appl. No.: 13/285,970

(22) Filed: Oct. 31, 2011

(65) Prior Publication Data

US 2012/0063851 A1 Mar. 15, 2012

Related U.S. Application Data

(62) Division of application No. 12/207,337, filed on Sep. 9, 2008.

(51) Int. Cl.
*E02D 13/04* (2006.01)

(52) U.S. Cl. ..... 405/227

(58) Field of Classification Search ..... 405/224, 405/226, 227, 228, 244, 249, 256, 257
See application file for complete search history.

(56) References Cited

U.S. PATENT DOCUMENTS

| | | | | |
|---|---|---|---|---|
| 955,729 | A | 4/1910 | Welsh | |
| 3,646,598 | A | 2/1972 | Chelminski | |
| 3,984,991 | A | 10/1976 | Kagler, Jr. | |
| 4,102,143 | A | 7/1978 | Phares et al. | |
| 4,129,009 | A * | 12/1978 | Jansz | 405/227 |
| 4,238,166 | A * | 12/1980 | Gendron | 405/228 |
| 4,516,882 | A * | 5/1985 | Brewer et al. | 405/224 |
| 5,020,764 | A | 6/1991 | Yamamoto | |
| 5,026,226 | A * | 6/1991 | Hollowell et al. | 405/211 |
| 5,145,284 | A | 9/1992 | Hulett et al. | |
| 5,228,806 | A * | 7/1993 | De Medieros et al. | 405/231 |
| 5,551,804 | A | 9/1996 | Breaux et al. | |
| 5,582,491 | A | 12/1996 | Pardue, Sr. | |
| 6,106,199 | A * | 8/2000 | Medeiros et al. | 405/224 |
| 6,142,709 | A | 11/2000 | De Medeiros Junio et al. | |
| 6,299,385 | B1 * | 10/2001 | Barnes | 405/227 |
| 6,312,195 | B1 | 11/2001 | De Medeiros Junio et al. | |
| 6,318,933 | B1 | 11/2001 | De Medeiros, Jr. et al. | |
| 6,536,993 | B2 | 3/2003 | Strong et al. | |

FOREIGN PATENT DOCUMENTS

| | | | |
|---|---|---|---|
| GB | 2163800 | A * | 3/1986 |
| GB | 2257988 | A | 1/1993 |
| NL | 8001497 | A * | 10/1981 |

* cited by examiner

*Primary Examiner* — Sunil Singh
(74) *Attorney, Agent, or Firm* — Wong, Cabello, Lutsch, Rutherford & Brucculeri, L.L.P.

(57) ABSTRACT

A driven pile anchor suitable for securing a tendon of a tension leg platform to the seafloor is supplemented with added weight. A load frame is added to the individual pile to accommodate ballast weights. Pre-manufactured ballast weights are placed on the frame to increase the holding power of the pile anchor system. In a second embodiment, the pile is intentionally plugged and installed with the plug intact. Pre-manufactured ballast weights are then placed inside the pile and may be held in place by gravity. In a third embodiment, the pile is a conventional driven friction pile installed with an underwater pile hammer. The pile is initially open but subsequently evacuated and intentionally plugged near its pile tip. Pre-manufactured ballast weights are placed inside the pile to increase its holding capacity. The first embodiment may be retrofitted to existing, driven-pile anchor systems.

12 Claims, 3 Drawing Sheets

BALLASTED DRIVEN PILE

CROSS-REFERENCE TO RELATED APPLICATIONS

This application is a divisional of U.S. application Ser. No. 12/207,337 filed Sep. 9, 2008.

STATEMENT REGARDING FEDERALLY SPONSORED RESEARCH OR DEVELOPMENT

Not Applicable

BACKGROUND OF THE INVENTION

1. Field of the Invention

This invention relates to subsea, driven-pile anchor systems. More particularly, it relates to subsea piles used to anchor the tendons of tension leg platforms or other vertically-moored structures to the seafloor.

2. Description of the Related Art Including Information Disclosed Under 37 CFR 1.97 and 1.98

A Tension-Leg Platform or TLP is a vertically moored floating structure normally used for the offshore production of oil or gas, and is particularly suited for water depths greater than 300 meters (about 1000 ft). The design has also been proposed for wind turbines.

The platform is permanently moored by means of tethers or tendons grouped at each of the structure's corners. The tendons have relatively high axial stiffness (low elasticity) such that virtually all vertical motion of the platform is eliminated. This feature allows the platform to have the production wellheads on deck (connected directly to the subsea wells by rigid risers), instead of on the seafloor. This makes for a less expensive well completion and provides better control over the production from the oil or gas reservoir.

Conventionally, the tendons of a TLP are secured to pile foundations comprising tubular piles driven into the seafloor by mechanical hammers. Such anchoring means provides high resistance to the tensile load applied by the floating TLP through the tendons.

U.S. Pat. No. 5,551,804 discloses a method of driving a pile wherein a pile is plugged at its lower end or tip region so as to make it easier to drive. Additionally, such a plugged pile facilitates the transportation and handling of the pile prior to its driving. This invention comprises the use of a plug at or near the bottom or end of a pile during handling, assembly, and lowering of the pile to self support in the sea bottom, followed by the driving of the pile with the plug intact. General consensus in the industry is that the plug will make the driving of the pile more difficult since it presents more of a profile that must be moved through the soil. However, this was not found to be the case in highly sensitive clays; the driving of a plugged pile is considerably easier than the driving of an open pile. While plugs have been employed in the past to facilitate certain aspects of pile transportation, handling, assembly, and lowering, they were always removed prior to pile driving because of the belief that the plug would make the pile more difficult or impossible to drive. Previously, the advantages derived from using plugs did not compensate for the costs related to installing and removing the plugs.

U.S. Pat. Nos. 6,318,933 and 6,142,709 describe a foundation system for tension leg platforms without a foundation template, wherein each tendon is directly connected to a socket inside the pile, the piles being positioned for driving purpose by means of a pile-driving template which is employed as a spacing device is described. The pile-driving template is positioned with the aid of pins that slot into guides built into the well template. After the groups of piles needed to anchor a corner of the platform have been driven in, the pile-driving template is withdrawn and repositioned so as to enable the piles for the other group of legs to be driven; this process continues until all of the pile-driving is finished. Alternatively one single pile-driving template may be employed to guide the driving of all the piles thus doing away with the need to reposition the template every time. The bottom ends of the piles are conical in shape, and after the piles have been driven they are filled with a high specific gravity material.

U.S. Pat. No. 3,984,991 describes an anchor which includes a tubular body, a top closure and a bottom closure secured to opposite ends of the tubular body, a plurality of drilling cutters mounted on the bottom closure, a neck having an external groove therein secured to the top closure, an opening in both the top and bottom closures, means for co-acting with a drill string extending into the closures for sealing to maintain the interior of the body substantially free of water when submerged, a ratchet collar adapted to co-act with a mating ratchet collar of the drill string for rotating the anchor to cause it to drill into the bottom of a body of water, a swivel adapted to be lowered onto the neck of the top closure when it has been set, latching dogs engaging in the external groove to secure the swivel to the body, and floatation means for signaling the surface that the swivel is set. The method of setting an anchor assembly including the steps of lowering an anchor body having cutters on the bottom thereof on the end of a drill string extending through the top of the anchor body and into the bottom for circulation of drilling fluid onto the face of the formation being drilled, the drill string being sealed to the anchor body to prevent entry of water therein, rotating the drill string and anchor body to drill the hole and lower the anchor body into the hole simultaneously, cementing around the exterior of the anchor body, then cementing the interior of the anchor body, lowering a swivel onto the top of the anchor body and signaling the seating of the swivel.

U.S. Pat. No. 5,582,491 describes a system to increase the tension capacity of pipe piles driven into the ocean floor. A pile cap is attached to a pipe pile. A partition is installed below the pile cap creating an air chamber between them that is at surface atmospheric air pressure. An external conduit containing a valve that is closed connects the pile's interiors above and below the partition. The pile is driven into the ocean floor filled with entrapped sea water below the partition so that little or no soil core is generated. After the clay soils adjacent to the pile have regained their strength, the valve is opened. A small amount of sea water expands into the air chamber. The pressure on both sides of the partition and the bottom of the pile cap is now slightly above surface atmospheric air pressure. It is the that the downward force of hydrostatic pressure on top of the pile cap increases the tension capacity of the driven pile.

U.S. Pat. No. 6,536,993 describes an apparatus for providing a mooring anchorage and a method of drilling and installing a pile in ground comprising the steps of: providing a pile, providing a drill bit at an end of the pile rotatable relative to the pile, engaging the ground with the drill bit, and rotating the drill bit relative to the ground and the pile generating a hole into which the pile is received.

U.S. Pat. No. 6,312,195 describes a method of installing a foundation for a tension leg platform that eliminates the foundation template as a permanent, load bearing part of the foundation. Piles are installed by, for example, being driven into the ocean floor so that each pile is secured to the ocean floor, but is unsecured to any other structure that is on the ocean floor. A tension leg platform is coupled via tendon structures to the piles so that anchoring load paths are defined from the tension leg platform to the ocean floor in a plurality of generally vertical paths extending in axial alignment through the tendon structures to the pile and the ocean floor. Each of the tendon structure to pile anchoring systems is said to be substantially independent of one another.

U.S. Pat. No. 5,020,764 describes a pole ballasting device adapted to be positioned about the lower end of one or more poles of a pole-using temporary structure for the purpose of holding the poles. The device includes at least two discrete blocks having, in their assembled condition, one or more common vertically extending through holes for receiving the poles therethrough. The blocks are arranged along planes passing through the through holes. A joining mechanism is provided for separably joining the blocks into a unit. A container is formed in at least one of the blocks and adapted to contain a fluidic load therein.

BRIEF SUMMARY OF THE INVENTION

The present invention comprises a method for improving the performance of Single Piece Tension Piles such as those conventionally used to anchor TLP's. The piles may be configured one per tendon and driven to design penetration depth with an underwater pile hammer. Subsequent to being driven, pre-manufactured ballast weights are added to the pile to improve its tension capacity beyond what is achieved from skin friction and the weight of the pile itself. The ballast can be added either internally, externally on a load frame or a combination thereof.

The practice of the invention requires no mechanical connection between the pile (or load frame) and the ballast weights other than that provided by gravitational forces. This greatly simplifies the installation process. The ballast weights may offer other improvements to the foundation's performance beyond an increase in tension capacity. In certain preferred embodiments, there are provided certain unique features on the driven pile that allow the ballast weights to transfer gravity loads. These features include, but are not limited to, load shoulders, shear keys, forged lugs, and other fabricated apparatus.

BRIEF DESCRIPTION OF THE SEVERAL VIEWS OF THE DRAWING(S)

DETAILED DESCRIPTION OF THE INVENTION

Figure 1B:
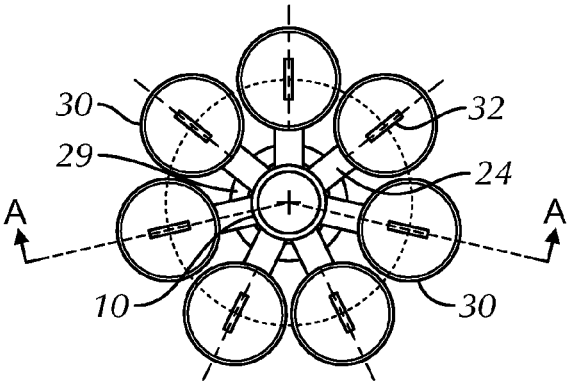
FIG. 1B is a top plan view of the embodiment shown in FIG. 1A.

The invention may best be understood by reference to certain illustrative embodiments which are shown in the drawing figures.

Figure 1C:
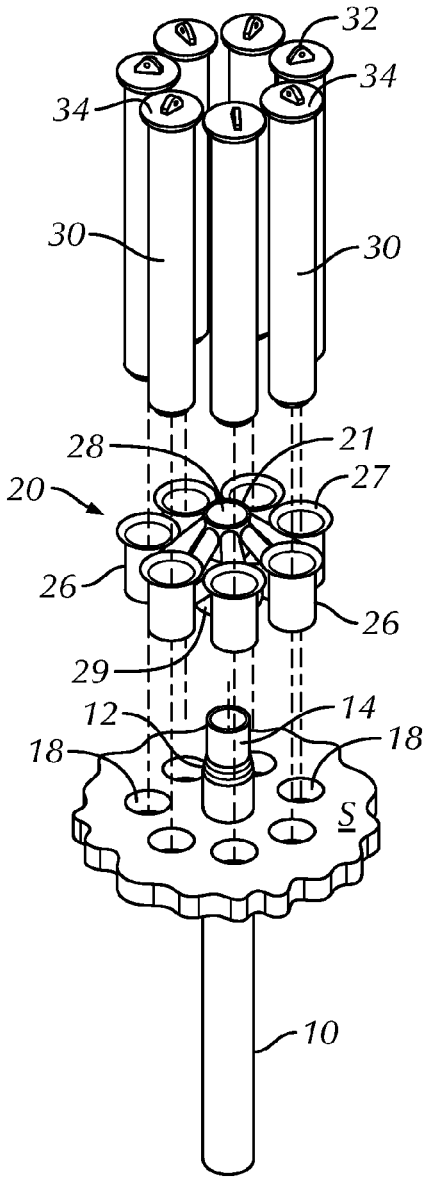
FIG. 1C is an exploded, perspective view showing the embodiment of FIG. 1A with the driven pile installed in the seafloor.
Figure 1A:
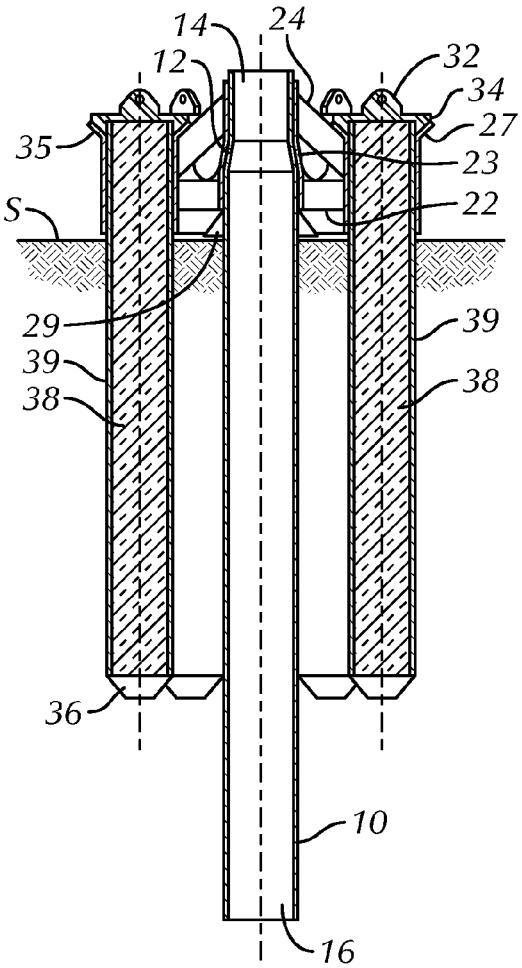
FIG. 1A is a cross-sectional view of a first embodiment of the invention taken along line A-A in FIG. 1B.

FIG. 1 depicts a single-piece, open-ended pile designed as a tension pile which may be lowered to the seafloor and set to self-penetration depth in the seafloor—i.e., the pile may sink in the mud at the bottom of the sea to a substantial depth under its own weight. The pile may then be driven to design penetration with an underwater hammer using equipment and methods conventional in the art.

A load frame may then be added to the installed pile. Pre-manufactured ballast weights are placed on the load frame thereby increasing the foundation pile's holding capacity, particularly in the vertical direction.

Referring particularly to FIG. 1B wherein the assembly is shown installed in seafloor S, driven pile 10 is a tubular structure having open end 16 at a first end and a section of reduced diameter (or "neck") 14 at an opposing second end. Shoulder 12 joins the two sections and provides a bearing surface for load frame 20.

In the particular embodiment shown in FIG. 1, load frame 20 comprises center member 21 sized to fit over the upper portion of pile 10. Center member 21 has central opening 28 for receiving pile 10 and may comprise sections of differing diameters joined by transition section 23. Transition section 23 may be sized and spaced to bear against shoulder 12 of pile 10 when installed, thereby providing a load path between pile 10 and load frame 20. Center member 21 may also comprise angled flange 29 at its lower end. Angled flange 29 helps to center load frame 20 on pile 10 when it is lowered into place during the installation procedure. Flange 29 will cam against the upper end of pile neck 14, thereby correcting for slight misalignments when the two components are joined.

Surrounding center member 21 are a plurality of equally-spaced receivers 26 which are joined to center member 21 by radial arms 22 and angled braces 24. The upper end of each receiver 26 may be provided with flared portion 27 which acts to align corresponding weight 30 as it is lowered into weight receiver 26 and also provides a stop for weight 30 when fully installed in load frame 20.

Each weight 30 has a lifting eye 32 at a first end and a conical or frusto-conical tip 36 at an opposing second end. Tip 36 may assist the centering of weight 30 in receiver 26 during installation and assist the penetration of weight 30 in seafloor S. As shown in FIG. 1C, the installation of weights 30 in load frame 20 creates penetrations 18 in seafloor S. Weight 30 may have a flange 34 at its upper end which may have undersurface 35 configured to rest on flared portion 27 of weight receiver 26.

Weight 30 may be solid or, alternatively, may comprise a tubular member having wall 39 defining a central cavity which may be filled with ballast 38. Ballast 38 may comprise any suitable, high-density material, such as concrete, iron, iron ore or lead. One particular iron ore which may be used in this application is hematite (or haematite) which is the mineral form of Iron(III) oxide ($Fe_2O_3$), one of several iron oxides. It typically exhibits a specific gravity of between 4.9 and 5.3. Hematite is a mineral, colored black to steel or silver-gray, brown to reddish brown, or red. It is mined as the main ore of iron. Hematite is harder than pure iron, but much more brittle.

Another example of a suitable ballast material for weight 30 is Barite (or Baryte), a mineral consisting of barium sulfate ($BaSO_4$). It is generally white or colorless, and is the main source of barium. The mineral is also called "heavy spar" or "tiff." The radiating form is sometimes referred to as Bologna Stone. Its Mohs hardness is 3, and it has a specific gravity of 4.3-5. Its crystal structure is orthorhombic.

Figure 2B:
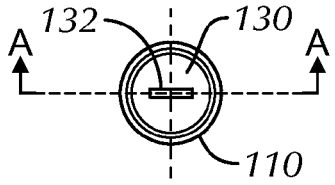
FIG. 2B is a top plan view of the embodiment shown in FIG. 2A.
Figure 2A:
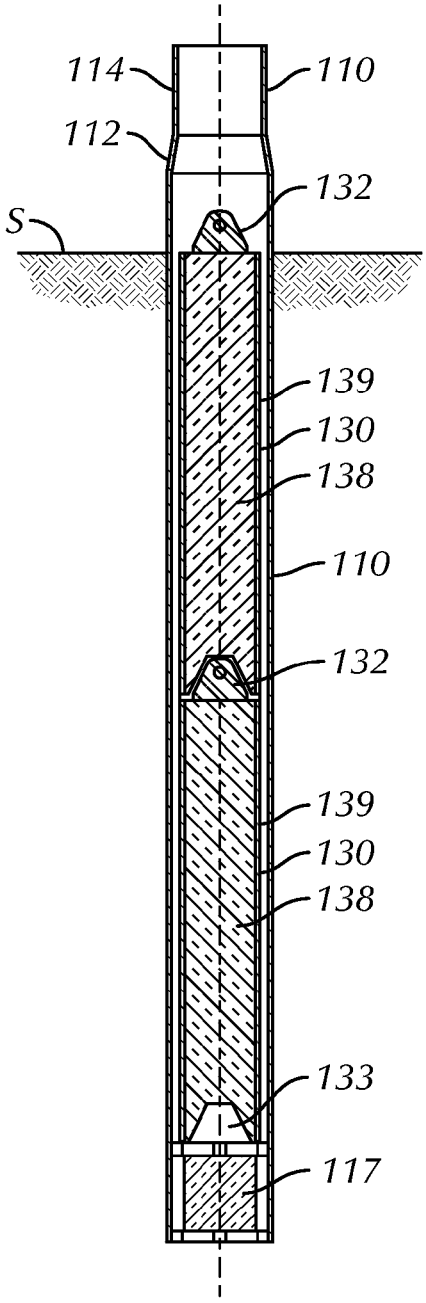
FIG. 2A is a cross-sectional view of a second embodiment of the invention taken along line A-A in FIG. 2B.
Figure 2C:
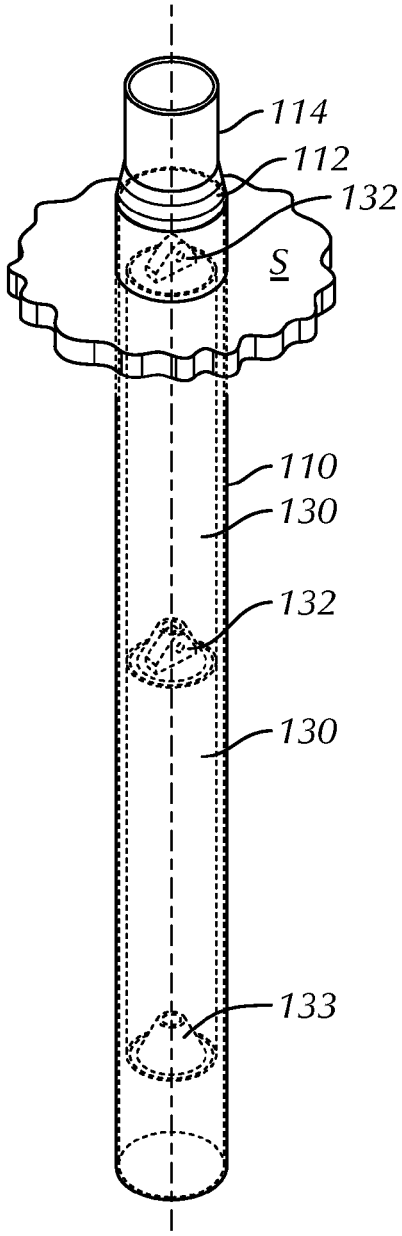
FIG. 2C is a perspective view, partially in phantom, showing the embodiment of FIG. 2A installed in the seafloor.

FIG. 2 depicts another embodiment of the invention which employs a single-piece, intentionally plugged (closed ended) pile designed as a tension pile. During installation, the pile is lowered to the seafloor with the plug intact. The pile is then set to self-penetration depth in the seafloor and subsequently driven to design penetration using an underwater hammer or other conventional means.

Pre-manufactured ballast weights are then placed internally in the central cavity of the pile to increase the vertical holding capacity of the foundation pile.

Referring to the cross-sectional view of FIG. 2A, driven plugged pile 110 is shown installed in seafloor S. As is conventional, pile 110 may be a tubular member having sections of differing diameter. For example, the upper end of plugged pile 110 may comprise neck 114 joined to the lower section of pile 110 by shoulder 112. Neck 114 may have a smaller o.d. than the lower section of pile 110 to facilitate connection to tendon connectors (not shown).

The opposing, lower end of pile 110 may be closed, either by a metal cap member or, as shown in FIG. 2B, by permanent grout plug 117 which may be installed in pile 110 prior to its installation in the seafloor.

Following its installation in the seafloor, one or more pre-manufactured ballast weights 130 may be placed in the central cavity of plugged pile 110. Ballast weights 130 may comprise lifting padeye 132 at a first end and a recess 133 at an opposing second end which is sized and shaped to accommodate the padeye 132 of the ballast weight 130 stacked below it.

Weight 130 may be solid or, alternatively, may comprise a tubular member having wall 139 defining a central cavity which may be filled with ballast 138. Ballast 138 may comprise any suitable, high-density material, such as concrete, iron, iron ore or lead. One particular iron ore which may be used in this application is hematite (or haematite) which is the mineral form of Iron(III) oxide ($Fe_2O_3$), one of several iron oxides. It typically exhibits a specific gravity of between 4.9 and 5.3. Hematite is a mineral, colored black to steel or silver-gray, brown to reddish brown, or red. It is mined as the main ore of iron. Hematite is harder than pure iron, but much more brittle.

Another example of a suitable ballast material for weight 30 is Barite (or Baryte), a mineral consisting of barium sulfate ($BaSO_4$). It is generally white or colorless, and is the main source of barium. The mineral is also called "heavy spar" or "tiff." The radiating form is sometimes referred to as Bologna Stone. Its Mohs hardness is 3, and it has a specific gravity of 4.3-5. Its crystal structure is orthorhombic.

Figure 3B:
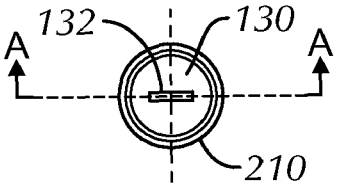
FIG. 3B is a top plan view of the embodiment shown in FIG. 3A.
Figure 3A:
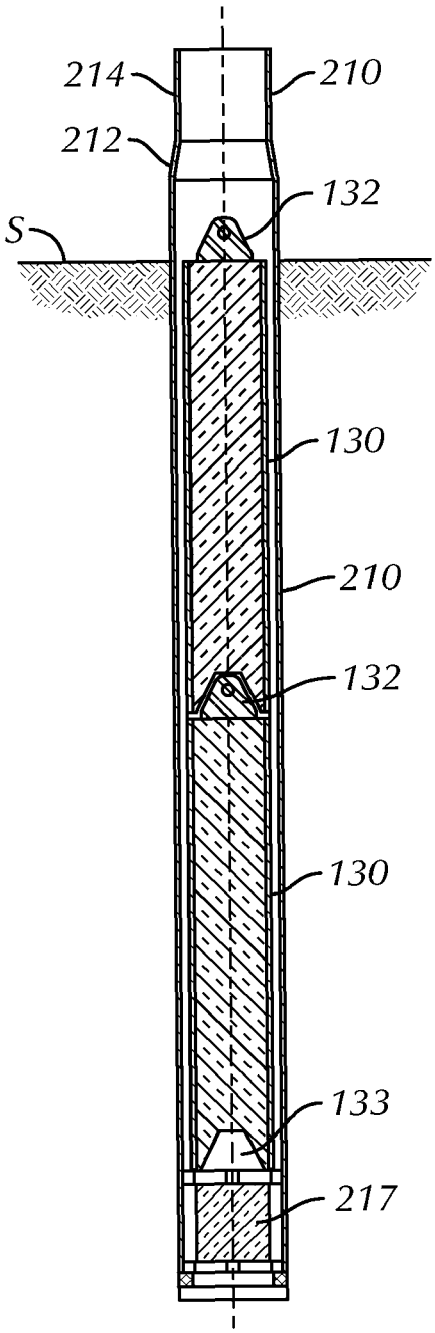
FIG. 3A is a cross-sectional view of a third embodiment of the invention taken along line A-A in FIG. 3B.
Figure 3C:
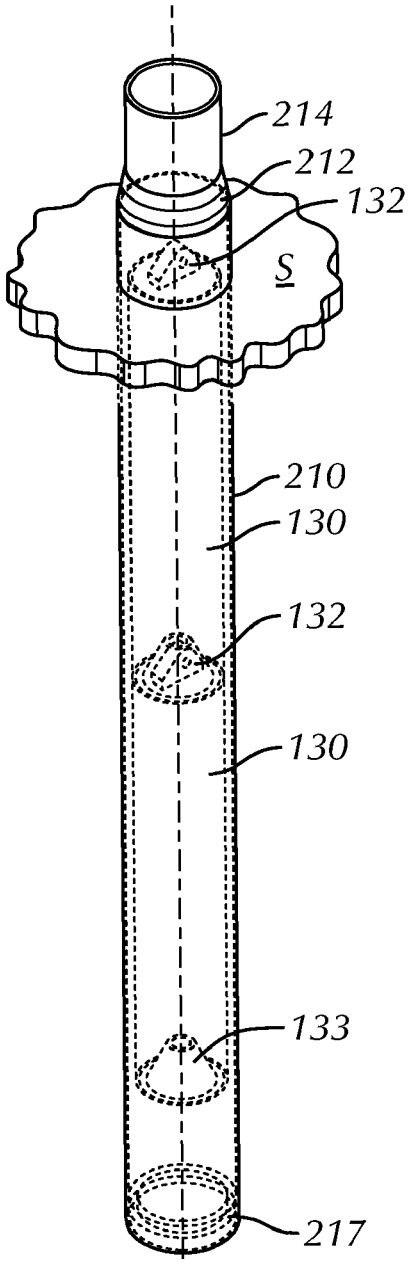
FIG. 3C is a perspective view, partially in phantom, showing the embodiment of FIG. 3A installed in the seafloor.

Yet a third embodiment of the invention is illustrated in FIG. 3. FIGS. 3A, 3B and 3C show three views of a single-piece, open-ended pile designed as a tension pile. During installation, the pile is lowered to the seafloor and allowed to set to self-penetration depth in the seafloor. It may then be driven to design penetration with an underwater hammer or other means well-known in the art. Following driving, the interior of the pile may be jetted out or otherwise treated to remove the soil plug.

A permanent plug that is capable of supporting ballast weights and transferring shear loads to the driven pile may then be set near the pile tip.

Pre-manufactured ballast weights are placed in the central internal cavity of the pile to increase the foundation pile's vertical holding capacity.

Referring in particular to the cross-sectional view of FIG. 3A, driven pile 210 is shown installed in seafloor S. As is conventional, pile 210 may be a tubular member having sections of differing diameter. For example, the upper end of plugged pile 210 may comprise neck 214 joined to the lower section of pile 210 by shoulder 212. Neck 214 may have a smaller o.d. than the lower section of pile 210 to facilitate connection to tendon connectors (not shown).

The opposing, lower end of pile 210 may be closed subsequent to its installation in the seafloor by removing the resulting soil plug from its central cavity either by jetting or other suitable means known in the art. Grout plug 217 may then be installed at the lower terminus of pile 210.

Following its installation in the seafloor, jetting and plugging, one or more pre-manufactured ballast weights 130 may be placed in the central cavity of plugged pile 210. Ballast weights 130 may comprise lifting padeye 132 at a first end and a recess 133 at an opposing second end which is sized and shaped to accommodate the padeye 132 of the ballast weight 130 stacked below it.

Weight 130 may be solid or, alternatively, may comprise a tubular member having wall 139 defining a central cavity which may be filled with ballast 138. Ballast 138 may comprise any suitable, high-density material, such as concrete, iron, iron ore or lead. One particular iron ore which may be used in this application is hematite (or haematite) which is the mineral form of Iron(III) oxide ($Fe_2O_3$), one of several iron oxides. It typically exhibits a specific gravity of between 4.9 and 5.3. Hematite is a mineral, colored black to steel or silver-gray, brown to reddish brown, or red. It is mined as the main ore of iron. Hematite is harder than pure iron, but much more brittle.

Another example of a suitable ballast material for weight 30 is Barite (or Baryte), a mineral consisting of barium sulfate ($BaSO_4$). It is generally white or colorless, and is the main source of barium. The mineral is also called "heavy spar" or "tiff." The radiating form is sometimes referred to as Bologna Stone. Its Mohs hardness is 3, and it has a specific gravity of 4.3-5. Its crystal structure is orthorhombic.

It will be appreciated by those skilled in the art that the embodiments of the invention illustrated in FIGS. 2 and 3 may be combined with the embodiment shown in FIG. 1—i.e., ballast weights 130 may be added to the central driven pile 10 to further increase its holding power.

Although the invention has been described in detail with reference to certain preferred embodiments, variations and modifications exist within the scope and spirit of the invention as described and defined in the following claims.

What is claimed is:

1. A method for increasing the pull-out resistance of a pile anchor in the seafloor comprising:

driving a pile anchor into the seafloor with an underwater hammer;

then placing a load frame having a plurality of weight-receiving receptacles on the pile anchor; and, inserting pre-manufactured ballast weights in the weight-receiving receptacles wherein the pile anchor comprises a tubular member having a first, lower section of larger diameter and second, upper section of smaller diameter and a shoulder joining the first section and the second section and the load frame is configured to bear against the shoulder.

2. A method as recited in claim 1 wherein the pre-manufactured ballast weights comprise iron ore.

3. A method as recited in claim 2 wherein the iron ore comprises hematite.

4. A method as recited in claim 1 wherein the pre-manufactured ballast weights comprise concrete.

5. A method as recited in claim 1 wherein the pre-manufactured ballast weights comprise barite.

6. A method as recited in claim 1 wherein an upward force applied to the load frame is not transmitted to the pile.

7. A method as recited in claim 1 wherein placing the load frame on the pile anchor comprises placing the load frame proximate the seafloor.

8. A method as recited in claim 1 wherein placing the load frame on the pile anchor comprises centering the load frame on the pile anchor.

9. A method for increasing the pull-out resistance of a pile anchor in the seafloor comprising:

driving a pile anchor into the seafloor with an underwater hammer;

then placing a load frame having a plurality of substantially tubular weight-receiving receptacles on the pile anchor; and, inserting substantially cylindrical, pre-manufactured ballast weights having a padeye on a first end and a conical or frusto-conical section on an opposing second end in the weight-receiving receptacles.

10. A method as recited in claim 9 wherein the ballast weights comprise a flange proximate the upper end thereof which flange bears against the weight receptacle when the ballast weight is fully inserted in the receptacle.

11. A method as recited in claim 10 wherein the flange comprises a beveled lower surface.

12. A method as recited in claim 11 wherein the weight receptacle comprises flared upper end configured and sized to engage the beveled lower surface on the flange of the ballast weight.

* * * * *